US008152322B1

(12) United States Patent
McGinty

(10) Patent No.: US 8,152,322 B1
(45) Date of Patent: Apr. 10, 2012

(54) HEAT DISSIPATING HELMET AND LIGHT

(76) Inventor: Patrick McGinty, Signal Mountain, TN (US)

( * ) Notice: Subject to any disclaimer, the term of this patent is extended or adjusted under 35 U.S.C. 154(b) by 281 days.

(21) Appl. No.: 12/543,797

(22) Filed: Aug. 19, 2009

Related U.S. Application Data

(60) Provisional application No. 61/148,374, filed on Jan. 29, 2009.

(51) Int. Cl.
*F21V 21/084* (2006.01)

(52) U.S. Cl. ..... 362/105; 362/106

(58) Field of Classification Search ..... 362/105–106
See application file for complete search history.

(56) References Cited

U.S. PATENT DOCUMENTS

| | | | | |
|---|---|---|---|---|
| 4,012,794 | A | 3/1977 | Nomiyama | |
| 4,195,328 | A | 3/1980 | Harris, Jr. | |
| 4,484,363 | A * | 11/1984 | Varanese | 2/209.13 |
| 5,173,839 | A | 12/1992 | Metz, Jr. | |
| 5,207,500 | A | 5/1993 | Rios et al. | |
| 5,829,065 | A | 11/1998 | Cahill | |
| 5,871,271 | A | 2/1999 | Chien | |
| 6,598,236 | B1 | 7/2003 | Gantt | |
| 6,799,864 | B2 | 10/2004 | Bohler et al. | |
| 6,827,130 | B2 | 12/2004 | Larson | |
| 6,955,444 | B2 | 10/2005 | Gupta | |
| 6,974,442 | B2 | 12/2005 | Grahn et al. | |
| 6,999,318 | B2 | 2/2006 | Newby | |
| 7,010,813 | B2 | 3/2006 | Ahn et al. | |
| 7,040,388 | B1 | 5/2006 | Sato et al. | |
| 7,219,371 | B2 | 5/2007 | Liu | |
| 7,252,407 | B2 * | 8/2007 | Lewis | 362/294 |
| 7,296,304 | B2 | 11/2007 | Goldsborough | |
| 7,376,980 | B2 | 5/2008 | Bullock et al. | |
| 7,489,031 | B2 | 2/2009 | Roberts et al. | |
| 2005/0265015 | A1 | 12/2005 | Salazar | |
| 2008/0080171 | A1 | 4/2008 | Lombard et al. | |
| 2008/0170382 | A1 | 7/2008 | Mass et al. | |
| 2008/0266838 | A1 | 10/2008 | Lin | |

* cited by examiner

*Primary Examiner* — Robert May
(74) *Attorney, Agent, or Firm* — Stephen J. Stark; Miller & Martin PLLC

(57) ABSTRACT

A heat dissipating helmet provides a heat dissipating material portion. One or more high powered LEDs may be in thermal contact therewith providing a significant portion of a heat sink to remove heat from the LEDs to maintain them at a proper operating temperature during operation. The heat dissipating material may be also in contact with air flow as the helmet moves through space thereby allowing convection to assist in removing heat from the helmet. Furthermore, heat moving elements located internal to the helmet may assist in transferring heat to the heat dissipating material from the scalp of a wearer.

17 Claims, 2 Drawing Sheets

HEAT DISSIPATING HELMET AND LIGHT

CLAIM OF PRIORITY

This application claims the benefit of U.S. Provisional Patent Application No. 61/148,374 filed Jan. 29, 2009 which is incorporated by reference.

FIELD OF THE INVENTION

The present invention relates to an improved safety helmet with lighting and more particularly to a safety helmet such as a bicycle helmet having high powered LEDs requiring a heat sink for proper operation with the heat sink incorporated into a part of an exterior shell of the helmet for heat transfer away from the LEDs.

BACKGROUND OF THE INVENTION

Lighting on helmets is not new. U.S. Pat. No. 4,195,328 shows an early lighting system providing for an auxiliary headlight to be mounted on a safety helmet 26. The light utilizes a halogen quartz lamp 124 with a reflector 126. In order to address heating concerns, slots 114,118 with a perforated lens cover 116 so as to "permit a dissipation of any internal heat from lighting elements." Such a heat removal system would probably work for halogen lighting but would not be expected to satisfactory remove heat from a high power LED. Other lighted helmet constructions include U.S. Patent Application Nos. 2008/0080171, 2008/0170382, 2008/026638 and 2005/0265015.

U.S. Pat. No. 5,871,271 discusses the use of a ten candle power LED as a headlight which would appear to be a low power LED. A common conversion in the green light spectrum is believed to be 680 lumens per watt. 12.7 lumens are a candle power. A conversion of ten candle power to watts provides what appears to be a LED having a maximum output wattage of approximately 0.2 watts. High power LEDs are commonly provided today are at least one, if not five or ten watts. A principal difference between high and low power LED is that a low power LED may provide sufficient lighting so that a rider might have increased visibility for safety concerns, while a high power LED would be much better suited for use as a headlight to illuminate a source at a distance. The headlight of the '271 Patent is not expected to provide significant illumination at a distance.

Even though U.S. Pat. No. 5,871,271 discloses the use of a ten candle power LED: "the headlight or reading function can be enhanced by using high brightness LEDs such as the 10 candlepower white LEDs manufactured by Toshiba corporation," high power LEDs were not a viable commercial option when that application was filed. Furthermore, based on the construction of placing the LEDs in a recess of the hard shell outer layer and not providing any separate heat removal capability as is shown in FIGS. 2, 3*a* and 3*b*, a high power LED substituted for a low power LED in that construction would result in burn out almost instantaneously due to the heat buildup and absence of a heat sink (low power LEDs do not normally require a heat sink of any significant size). The '271 Patent is believed to show the use of lights on bicycle helmets principally for the use of identifying the rider as opposed to illumination as a headlight.

References such as U.S. Pat. No. 6,955,444 show a surgical head light in which high powered LEDs are employed such as a one watt and a five watt LED which explicitly describe the need for a heat sink. There is no room for this bulky heat sink in constructions such as the '271 Patent. The '444 Patent describes a five watt LED requiring a heat sink four times that use for a one watt LED. The applicant and the owner of the '444 Patent have found that when purchasing an LED strong enough to provide headlights which can be clamped on to the head of the user such as on the helmet, that the heat sinks are heavy and bulky and thus "contribute[s] to discomfort for the wearer of the head mounted lamp" (Column 1, lines 45-48). In order to overcome the discomfort of heat sinks for high powered LEDs at five watts, this owner of the '444 Patent used three watt LEDs so that smaller heat sinks could be employed with such constructions than would otherwise be required for higher wattage bulbs.

Of course, references are available directed to various LED heat sinks such as U.S. Pat. No. 6,799,864, U.S. Pat. No. 7,040,388, U.S. Pat. Nos. 5,173,839, 7,489,031, 6,827,130 and 6,999,318 and probably others. Similarly, there are patents related to the cooling of helmets such as U.S. Pat. Nos. 6,598,236, 7,219,371, 7,296,304, 7,010,813 and others.

Nevertheless, in spite of the prior art related to the general idea of providing a helmet with LEDs or providing a head lamp for the head of a user, the applicant believes that a lightweight helmet without a separate bulky high power LED heat sink is needed for at least some applications with improvements over the prior art are believed to be necessary in various applications.

SUMMARY OF THE INVENTION

It is an object of at least some embodiments of the present invention to provide an improved helmet with high power LED headlight system.

It is another object of at least some embodiments of the present invention to provide an improved helmet having an integral external shell portion utilized as at least a portion of a heat sink in cooperation with high power LED lights.

It is another object of at least some embodiments of the present invention to provide an improved bicycle helmet having an exterior shell portion manufactured out of a thermal conductive material having higher thermal conductivity than plastic (i.e., greater than 1 W/m*K) in thermal communication with high power LEDs wherein the high thermal conductivity shell portion may be in contact with air flow under certain circumstances such as movement of the helmet through air thereby facilitating heat transfer by convection.

It is another object of at least some embodiments of the present invention to provide an improved helmet having a thermal conductive material shell portion possibly in thermal communication with a thermal transport system assisting in transporting heat from the scalp of a user to the thermal conductive portion.

In accordance with a presently preferred embodiment of the present invention, a helmet is constructed with a heat dissipating material portion for at least a portion of an exterior shall that provides the dual function of providing at least a portion of the structural protective shell exterior portion as well as a thermal dissipating surface area (a/k/a heat sink) for maintaining appropriate operation regarding temperature control of high powered LEDs connected to the helmet. The thermal conductor may also assist in dissipating heat from the head of the user which may be facilitated by having a higher thermal conductivity than traditional helmet material. Furthermore, one or more heat moving elements can be utilized to assist in transferring heat from the wearer's scalp to the heat dissipating material portion. The heat moving element could be as simple as a damp cloth or other structure or more complicated structures such as a liquid filled tubing system which could direct heat from the scalp to the thermal conducting material or elsewhere.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Helmet 10 is preferably constructed to include an outer or exterior shell 12 having a heat dissipating portion 14 which is illustrated comprised of a substantial portion, but possibly not all of the outer shell of the preferred embodiment. In other embodiments the heat dissipating portion 14 may comprise the entire outer shell 12.

Figure 1:
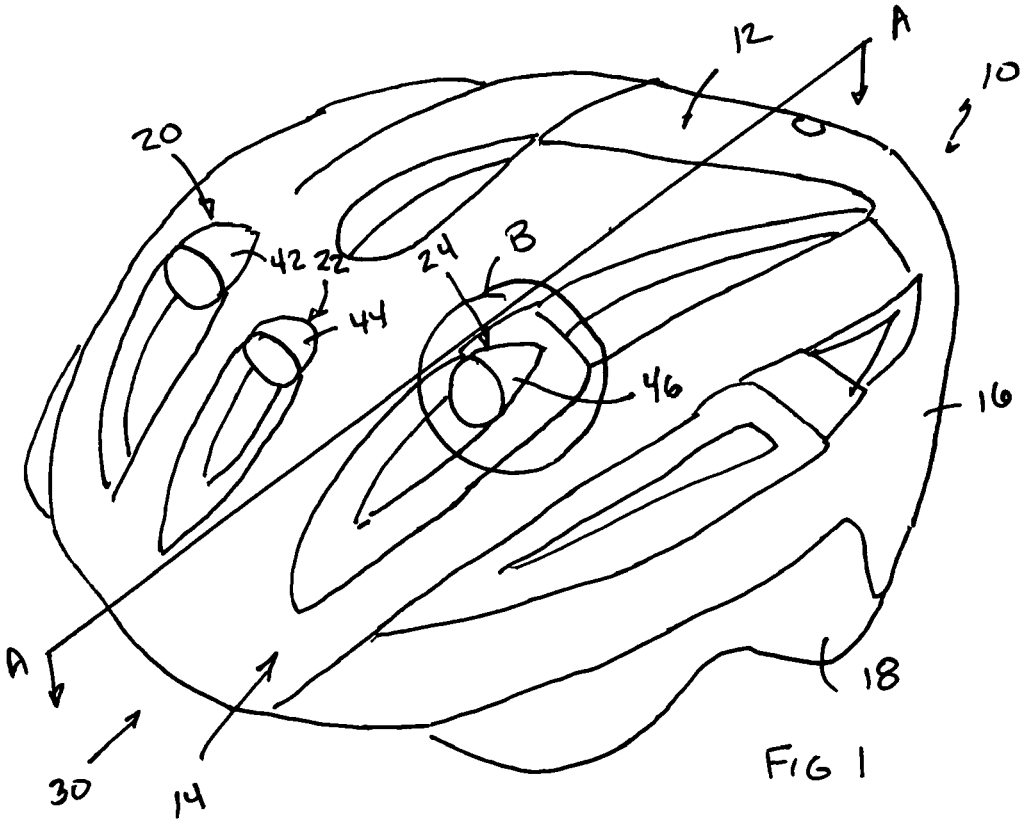
FIG. 1 is a top perspective view of a helmet constructed in accordance with the presently preferred embodiment of the present invention.

Helmet 10 is illustrated as a bicycle helmet, but other safety helmets are contemplated as well in various embodiments. As shown in FIG. 1, the heat dissipating portion 14 is connected to a traditional shell portion 16 which may terminate at an exterior portion prior to connecting to protective portion 18 which is typically polystyrene but could be any other material which supplies protection to the rider. Straps are not shown but would be employed for most safety helmets.

Figure 5:
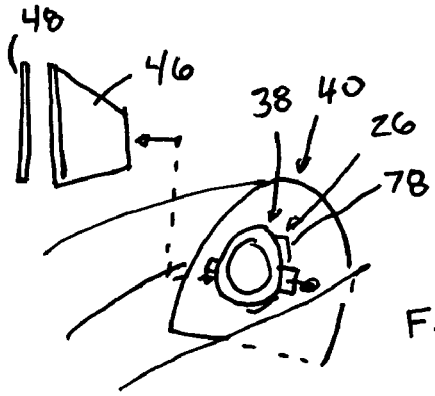
FIG. 5 is an exploded view of a detail B shown in FIG. 1.

The helmet 10 of the preferably preferred embodiment has at least one and preferably a plurality such as three head lights 20,22,24 which can be seen in an exploded detail view in FIG. 5. The heat dissipating portion 14 can serve as both a structural protective shell as a part of the outer shell 12 as well as provide heat dissipating surface area as is typically necessary for maintaining appropriate operating temperatures of high power LEDs such as LED 26 shown in FIG. 5. Furthermore, as will be explained below, the heat dissipating material 28 which could be aluminum, other thermally conductive metal or other material such as carbon (preferably having a conductivity over 5 W/m*K, if not over 30 W/m*K or even over 100 or 200 W/m*K). Other materials may also assist in dissipating heat from the head of a wearer as will be discussed in further detail below.

Instead of requiring large bulky heat sinks which are normally located immediately behind LEDs which would otherwise result in the spacing of the LED light source away from an exterior shell of the helmet 10, the applicant has discovered a rather unique way of incorporating a portion of the outer shell 12 as at least a portion if not the entire heat sink shell. One such way is to provide heat dissipating portion 14 as is shown in the figures. Wearability of the helmet 10 is also believed to be improved as a bulky separate heat sink is not attached towards the front of the front 30 of the helmet thereby affecting the balance of the helmet 10 and possibly the balance of the rider. This is believed to provide increased comfort and a safer helmet 10 than prior art configurations. Heat dissipating portion 14 may be any size such as at least half of exterior shell 12 or other appropriate size. Heat dissipating material portion 14 provides the heat sink for at least one, two and preferably all three LEDs 26.

Helmet 10 can be a multipurpose day/night light helmet. The headlights 20,22,24 are preferably low profile. By being low profile, they are preferably housed internal to slots so that an upper surface 38 of LED 26 is located below an upper surface 40 defining the slot. In the illustrated embodiment, reflectors 42,44,46 may extend above the upper surface 38 of the LED 28 when installed as is shown in FIG. 1, but may not be the case for all embodiments.

As can be seen in FIG. 5, which is a detail of headlight 24, lens cap 48 may cover the front of the reflector 46 at least in some embodiments. LEDs 26 are preferably high power LEDs meaning that they require at least about a watt of power if not about 5 watts or about 10 watts and preferably provide at least 300 lumens at $I_f$=2800 milliamps if not 700 lumens watts or at least 200 lumens with an $I_f$ of 1400 milliamps. The particular high performing LEDs utilized by the applicant were Model No. W724C0 (P7) manufactured by Seoul Semiconductor which provides a super high flux and high lamination, high current operation and low thermal resistance. Other high power LEDs 26 may be utilized in other embodiments. Traditional applications for these high power LEDs 26 have been automotive interior-exterior lighting, automotive signal lighting, automotive forward lighting, architectural lighting, projection light sources, traffic signals, etc. Information about this LED product can be found at www.zled.com.

High intensity LED light sources such as LED 26 are preferably directional in nature to be configured for various applications, although in at least one embodiment high power LED light sources can be forward facing for use as a headlight or spotlight like headlights 20,22,24. The heat dissipating thermal material shell portion 14 provides the dual purpose of structural integrity preferably over an inner cushioning layer 18 such as polystyrene while also serving as a thermal conductor element to which the high power LEDs 26 direct heat. The thermal dissipating material portion 14 functions as a heat sink to assist the high power LED maintain their operating temperatures. The thermal dissipating surface shell portion also may assist in dissipating heat from the wearer's scalp.

Figure 3:
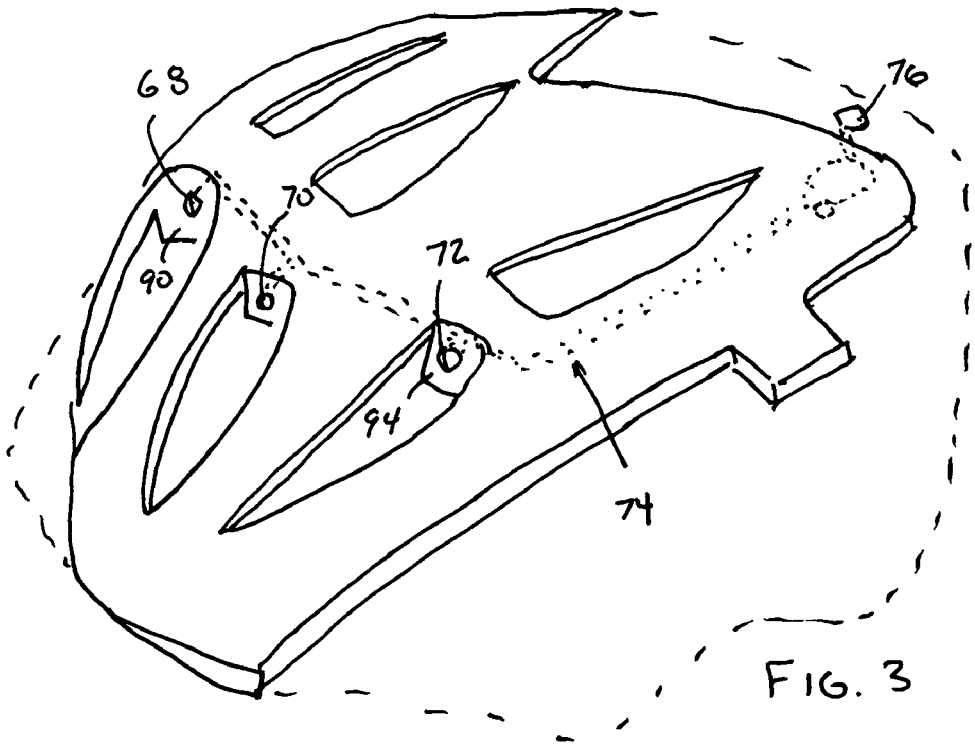
FIG. 3 is a view of the heat dissipating material shown in FIG. 1 with other portions of the helmet shown in phantom.

As can be seen from FIG. 1 and FIG. 3, the LEDs 26 are preferably connected at bores 68,70,72 from downwardly depending shoulders 90,92,94 to preferably thermally and integrally connected to the upper surface 40 of the thermal dissipating material portion 14. Other connections could be provided in contact therewith. Shoulders 90,92,94 are integrally connected to dissipating material portion 14 in the preferred embodiment but could be otherwise connected to the heat dissipating material portion 14 in other embodiments.

Figure 4:
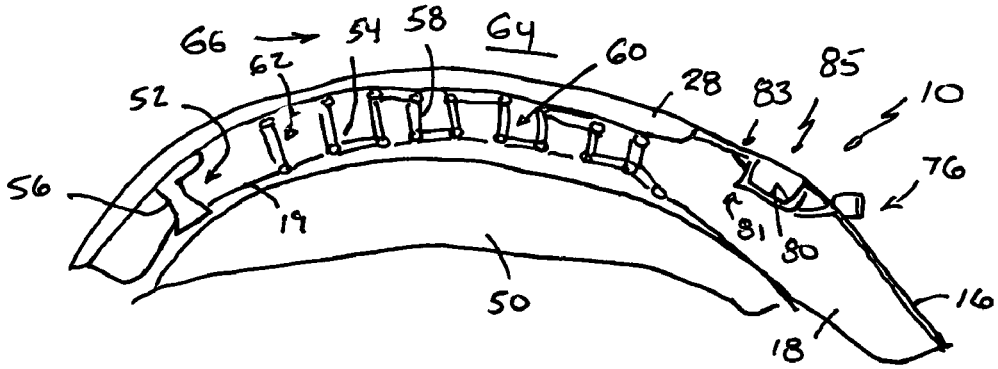
FIG. 4 is a cross section taken along the line A-A in FIG. 1.

Heat dissipation from the scalp 50, a portion of which is shown illustrated in helmet 10 in FIG. 4, can be facilitated by the use of heat moving elements 52,54. Heat moving element 52 is a fabric such as cloth 56 contacting scalp 50 which may be preferably damp and therefore assists in transferring heat through the cloth 52 to the heat dissipating material 14 as is shown in FIG. 4. Heat moving elements 52,54 transfer heat through the cushioning layer illustrated as protective portion 18 having inner surface 19. Heat is preferably transferred from the inner surface 19 through the heat moving elements 52,54 to contact the heat dissipating material portion 14 and then to the atmosphere 64. Protective portion 18 is preferably foamed polystyrene matrial.

In this embodiment and/or in other embodiments, more complicated heat moving elements 52,54 may be utilized such as liquid filled tubes or conductors 58 which may be a part of a connection network such as network 60 or may be one or more individual tubes such as tube 62 illustrated. These structures may direct heat to go from scalp 50 through the heat moving elements 52,54 toward and then through the heat dissipating material 28 to the atmosphere 64. Air 66 is illustrated moving across the helmet 10 such as when riding to assist in convection heat transfer which may assist conduction heat transfer through the use of heat moving elements 52,54.

As one can see from FIG. 3, bores 68,70,72 preferably provide locations to connect LED 26 thereto and then wiring 74 shown in phantom connecting to terminal 76 in which an external power supply can provide electricity thereto can be provided. Of course, in other embodiments, a battery pack may be incorporated as a portion of the helmet 10. Other constructions and/or electrical systems may be utilized in other embodiments.

The helmet 10 can provide protection to a wearer with a multipurpose base/night lighted helmet 10. The low profile of the headlights 20,22,24 can be useful in some embodiments. The choice of a protective shell material as it relates to the heat dissipating portion 14 can provide for heat dissipation from the LEDs 26 as well as structural protection for the exterior shell 12. Heat dissipating portions 14 may be constructed of aluminum or other metal or other materials which may be stronger than plastic coatings often utilized. Thermal conductivity greater than one (W/m*K) if not greater than ten, and even 100 W/m*K is envisioned. Plastic coating can certainly be a part of the traditional shell portion 16, but typically have a thermal conductivity less than one W/m*K. Of course, in other embodiments heat dissipating portions 14 can comprise the outer shell 12. The outer shell slows deceleration of the impact of the wearer's head during blunt trauma. The heat dissipating material 14 particularly if a metal conductor such as aluminum is utilized can be much stronger and much more resistant to breaking, puncture or otherwise failing in the event of an impact than the thin plastic coatings commonly employed in the market today.

Figure 2:
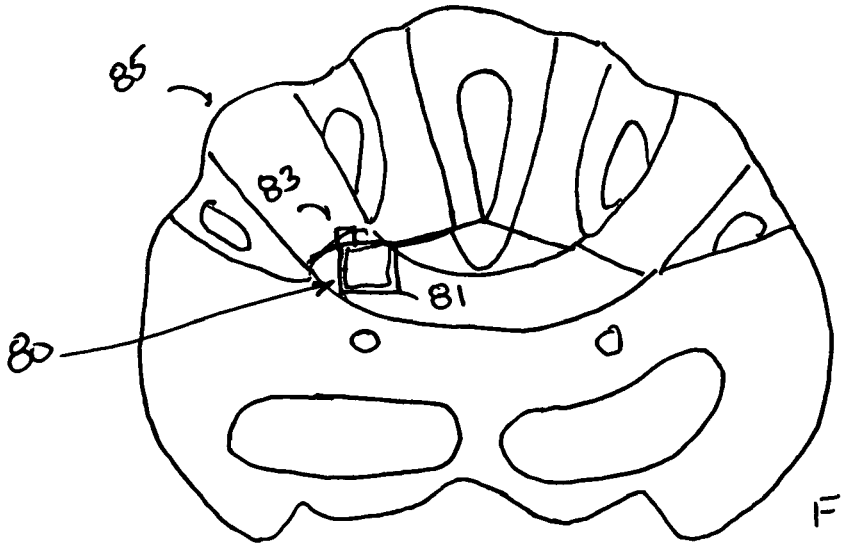
FIG. 2 is a rear view of the helmet shown in FIG. 1.

During daytime use head lamps 20,22,24 can be utilized to increase motorists' awareness and possibly prevent the need for multiple helmets while allowing reconfiguration of helmet based on use. Furthermore, the lights 20,22,24 may be selectively turned off as would be understood by those of ordinary skill in the art. FIG. 5 shows LED 26 connected to bore 72 with a thermally conductive heat proxy 78 although other thermal conductive materials can also be utilized in other embodiments. Arctic Fox™ was utilized by this embodiment although other connecters can be utilized in other connectors which would be include adhesive, solders, etc., to be utilized in various embodiments. Buck driver 80 is illustrated in FIG. 4 while other drivers could also be utilized such as Mofsest, etc. A buck type driver has been utilized as it is easily accessible and virtually indestructible. In fact, LED drive 80 may be a BUCK-PUCK™, in the form of a removable modular LED driver which can provide a constant current regulator to the LED lights 20,22,24. Buck driver 80 is illustrated contained within housing 81 which is preferably accessible from an exterior surface 85 of the helmet 10 such as is shown in FIGS. 2 and 4. Buck driver 80 may be located in housing 81 and possibly retained such as with connector 83 which could be a screw passing through the housing 81 and against the driver 80 to assist in retaining it in a desired storage configuration. Of course, other connections systems or retention systems can be utilized as are known in the art. By providing a removable driver 80 for at least some embodiments, the driver 80 can be replaced should it fail over the course of the life of the helmet 10. Custom production of Mofsest type power sources may also be utilized with commercially available helmets 10 as the helmet 10 is introduced through commercial production. Other drivers 80 may be utilized in other embodiments.

Lens cover 48 may be an acrylic focusing lens or other type of lens. Reflector 46 can be a parabolic front surface reflector or other reflector style in various embodiments.

A wiring harness 74 may be built under the surface of the protective shell 12 and possibly totally contained within the construction of the helmet 10. Access to replacement batteries may be provided internally or externally in various embodiments. Terminal 76 is provided for power to be externally provided for head lights 20,22,24 in the illustrated embodiment. The wiring harness 74 can provide electrical current to each of the LEDs 26 individually, in series/parallel configurations, etc., based on the needs of the particular embodiment. LED driver assemblies 80 could be single or multiple power sources such as a buck regulators, pulsed width modulator, Mofsest amplified regulators, possibly with a computer driven modes and inputs for common control the LEDs 26. Various embodiments may include individual mode functions for tailoring the LEDs function to the lighting situation or changing applications.

The inner cushion 18 may be similar to similar constructed to prior art polystyrene inner shell constructions which simply have a hard plastic outer layer and can provide the wearer protection from deceleration forces such as experienced on the head. Cushion 18 is intended to slow the rate of deceleration and distribute forces more evenly across the surface of the wearer's skull to hopefully avoid fracture and/or puncture. Various other materials and/or constructions could be utilized.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A safety helmet comprising:

a cushioning layer having an inner surface;

an exterior shell covering at least a portion of the cushioning layer, said exterior shell having a heat dissipating portion having a thermal conductivity exceeding at least about 5 W/m*K;

a high power LED light having a power of at least about 1 W connected to and in thermal communication with the heat dissipating portion of the exterior shell whereby the heat dissipating portion provides a heat sink for the high power LED light;

wherein the heat dissipating portion further comprises an upper surface and the LED light further comprises an upper surface, and the upper surface of the LED light is located below the upper surface of the heat dissipating portion.

2. The safety helmet of claim 1 further comprising a heat moving portion whereby the heat moving portion conductively transfers heat through the heat moving portion from the inner surface of the cushioning layer to the heat dissipating portion when in use.

3. The safety helmet of claim 2 wherein the heat moving portion comprises at least one of a damp fabric and a liquid filled conductor extending from the inner surface of the cushioning layer to the heat dissipating surface.

4. The safety helmet of claim 1 wherein the thermal conductivity of the heat dissipating portion exceeds about 200 W/m*K.

5. The safety helmet of claim 1 wherein the heat dissipating portion of the exterior shell provides at least half of the surface area of the exterior shell.

6. The safety helmet of claim 1 further comprising a removable driver securely connected to the helmet and in electrical communication with the LED light.

7. The safety helmet of claim 1 wherein the heat dissipating portion provides the heat sink for at least two LED lights connected thereto.

8. The safety helmet of claim 1 wherein the LED light is connected to a shoulder downwardly extending relative to the upper surface of the heat dissipating portion.

9. The safety helmet of claim 1 wherein the heat moving portion extends from the inner surface of the cushioning layer to the heat dissipating portion.

10. The safety helmet of claim 9 wherein the heat moving portion comprises at least one of a damp fabric and a liquid filled conductor.

11. A safety helmet comprising:

a cushioning layer having an inner surface;

a protective exterior shell exteriorly covering over the cushioning layer as a protective shell, said exterior shell having an exposed exterior heat dissipating portion having a thermal conductivity exceeding at least about 5 W/m*K; and a high power LED light having a power of at least about 1 W connected to and in thermal communication with the heat dissipating portion of other exterior side whereby the heat dissipating portion provides a heat sink for the high power LED light and provides structural integrity as a portion of the protective exterior shell; and wherein the heat dissipating portion further comprises an upper surface and the LED light further comprises an upper surface, and the upper surface of the LED light is located below the upper surface of the heat dissipating portion.

12. The safety helmet of claim 11 wherein the heat dissipating portion comprises at least half of a surface area of the exterior shell.

13. The safety helmet of claim 11 wherein the heat dissipating portion has a thermal conductivity of at least 100 W/m*K.

14. The safety helmet of claim 11 further comprising a high power LED light having a power of at least about 1 W connected to and in thermal communication with the heat dissipating portion of the exterior shell whereby the heat dissipating portion provides a heat sink for the high power LED light.

15. The safety helmet of claim 11 wherein the heat dissipating portion provides the heat sink for at least two LED lights connected thereto.

16. The safety helmet of claim 11 wherein the LED light is connected to a shoulder downwardly extending relative to the upper surface of the heat dissipating portion.

17. The safety helmet of claim 16 wherein the shoulder is integral to the upper surface of the heat dissipating portion.

* * * * *